US006683041B1

(12) United States Patent
Nissing et al.

(10) Patent No.: US 6,683,041 B1
(45) **Date of Patent: *Jan. 27, 2004**

(54) WET-LIKE ARTICLES COMPRISING A MULTI-PHASE, MULTI-COMPONENT EMULSION AND AN ACTIVATION WEB

(75) Inventors: Nicholas James Nissing, Cincinnati, OH (US); John Billings Burchnall, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/601,044

(22) PCT Filed: Jan. 25, 1999

(86) PCT No.: PCT/IB99/00111

§ 371 (c)(1),
(2), (4) Date: Jul. 26, 2000

(87) PCT Pub. No.: WO99/37747

PCT Pub. Date: Jul. 29, 1999

Related U.S. Application Data

(63) Continuation-in-part of application No. 08/761,733, filed on Dec. 5, 1996, now Pat. No. 5,908,707.

(60) Provisional application No. 60/072,448, filed on Jan. 26, 1998.

(51) Int. Cl.[7] ..... C11D 17/04

(52) U.S. Cl. ..... 510/438; 510/108; 510/130; 510/191; 510/214; 510/238; 510/439

(58) Field of Search ..... 510/438, 439, 510/130, 191, 108, 214, 238

(56) References Cited

U.S. PATENT DOCUMENTS

| | | | | | |
|---|---|---|---|---|---|
| 1,819,041 | A | | 8/1931 | Sherman | 428/211.1 |
| 3,965,519 | A | * | 6/1976 | Hermann | 15/104.93 |
| 4,342,314 | A | | 8/1982 | Radel et al. | 128/287 |
| 4,463,045 | A | * | 7/1984 | Ahr et al. | 428/131 |
| 4,741,944 | A | * | 5/1988 | Jackson et al. | 428/152 |
| 5,756,161 | A | * | 5/1998 | Taylor | 427/398.1 |
| 5,874,160 | A | * | 2/1999 | Keck | 428/198 |
| 5,908,707 | A | * | 6/1999 | Cabell et al. | 428/537.5 |
| 5,928,210 | A | * | 7/1999 | Ouellette et al. | 604/383 |
| 6,060,149 | A | * | 5/2000 | Nissing et al. | 428/138 |
| 6,153,208 | A | * | 11/2000 | McAtee et al. | 424/402 |
| 6,270,875 | B1 | * | 8/2001 | Nissing | 428/138 |
| 6,280,757 | B1 | * | 8/2001 | McAtee et al. | 424/402 |
| 6,495,151 | B2 | * | 12/2002 | McAtee et al. | 424/402 |

FOREIGN PATENT DOCUMENTS

| | | | |
|---|---|---|---|
| EP | 0365160 A2 | * | 4/1990 |
| EP | 0 353 014 B1 | | 1/1996 |
| GB | 1 276 228 A | | 6/1972 |
| WO | WO96/09435 A1 | * | 3/1996 |
| WO | WO 96/14835 A1 | * | 5/1996 |
| WO | WO 96/34035 A1 | * | 10/1996 |
| WO | WO 98/24871 A2 | * | 6/1998 |

OTHER PUBLICATIONS

"Moist Mates Moist Toilet Tissue on a Roll" in Lookout Magazine, Jul. 11, 2000 edition.

* cited by examiner

*Primary Examiner*—Lorna M. Douyon
(74) *Attorney, Agent, or Firm*—Carl J. Roof; Ian S. Robinson; Ken K. Patel

(57) ABSTRACT

Disclosed are disposable cleansing articles (1) which comprise a multi-phase, multi-component emulsion (5) and an activation web (2) that facilitates activation of the emulsion during use. In a preferred embodiment, the multi-phase emulsion is a high internal phase inverse emulsion having a continuous external lipid phase and a discontinuous internal polar phase. During use, the activation web facilitates breakage of the emulsion's external phase, thereby releasing the internal phase for its desired use. Because the internal liquid phase may account for up to about 97% of the emulsion, significant levels of fluid (e.g., water or a polar liquid) may be delivered from a "dry" wipe.

20 Claims, 4 Drawing Sheets

WET-LIKE ARTICLES COMPRISING A MULTI-PHASE, MULTI-COMPONENT EMULSION AND AN ACTIVATION WEB

CROSS REFERENCE

This application claims priority under 35 U.S.C. §371 to PCT International Application Ser. No. PCT/IB99/00111, filed Jan. 25, 1999 which claims the benefit of U.S. Provisional Application Ser. No. 60/072,448, filed Jan. 26, 1998; and is also a continuation-in-part under 35 U.S.C. §120 of Patent Application Ser. No. 08/761,733, filed Dec. 5, 1996, now U.S. Pat. No. 5,908,707 issued on Jun. 1, 1999.

FIELD OF THE INVENTION

The present invention relates to articles that are useful in a wide variety of cleansing applications. The invention particularly relates to wet-like cleaning wipes made from a textured carrier substrate treated with a multi-phase, multi-component emulsion which may be activated to release a liquid phase.

BACKGROUND OF THE INVENTION

In the art of personal and household cleaning, a number of approaches have been developed to address cleansing needs. These approaches may be broadly categorized into two main categories: those utilizing a substantially dry substrate and separate cleansing agent, and those utilizing an integrated substrate/cleansing agent combination.

The first approach is typically one wherein the user utilizes a dry substrate of his or her choosing having the desired absorptive and textural properties. Commonly utilized substrates include disposable and reusable paper towels, cloths of natural and/or synthetic origin, and the like. The user then applies a emulsion of the desired composition to either the target surface and/or to the dry substrate and then applies the substrate to the target surface for the desired wiping or cleansing activity. While this approach has been utilized for many years, it requires the user to maintain separate supplies of substrates and emulsions. Moreover, it is often inconvenient to transport the emulsion to remote locations in the types of containers typically utilized. Additionally, it is a matter of trial and error to determine the appropriate effective amount of emulsion to apply.

In an effort to address these consumer needs, in more recent times integrated substrate/cleansing agent products have been developed wherein the substrate is packaged for use with the desired amount of the emulsion already applied. One such example of a product of this genre is the pre-packaged, pre-moistened towelette often available at convenience stores for cleaning hands before or after eating. Another example is the pre-moistened "baby wipes" frequently utilized for child care activities. While such products have enjoyed a fair degree of commercial success, they do require a certain degree of packaging to prevent evaporation, contamination, or degradation of the emulsion prior to use. Moreover, depending upon the desired context, it is inconvenient to dispose of the packaging and, in the instance of multiple product packages, to separate wet substrates for individual use.

More recently, integrated substrate/cleansing agent products have been developed which address the concerns regarding preservation of a "wet" or activated implement in a usable condition. These articles utilize a textured carrier substrate treated with a multi-phase emulsion having a dispersed polar phase and a continuous lipid phase. These articles have a number of significant advantages over prior cleaning products, especially when in the form of wet-like cleansing wipes. These articles release significant quantities of the internal polar phase (e.g., water) during use for effective cleaning. The continuous lipid phase of the emulsion is sufficiently brittle so as to be easily disrupted by low shear contact (e.g., during the wiping of the skin) to readily release this internal phase, but sufficiently tough to avoid premature release of the internal phase during the rigors of processing. The continuous lipid phase of these articles is also sufficiently stable during storage so as to prevent significant evaporation of the internal polar phase.

These articles can be used in many applications requiring the delivery of a polar or liquid internal phase such as water, as well as actives that are dispersible in such polar materials. These applications include hard surface cleaning of floors, countertops, sinks, bathtubs, toilets, and the like, as well as the delivery of antimicrobial or pharmaceutical actives that are soluble or dispersible in polar liquids. These articles can also perform multiple functions. For example, the emulsion applied to these articles can be formulated to provide cleaning and waxing benefits at the same time when used on items such as furniture, shoes, automobiles, and the like.

While articles of this variety have proven successful in use, it is often difficult to either activate a sufficient amount of the emulsion to meet the end user's need or to efficiently deliver to the capacity of the emulsion loaded on the article. As a consequence, it is often necessary to overcompensate by increasing the emulsion loading of the carrier material to ensure an adequate quantity of the internal polar phase will be made available for use.

Accordingly, it would be desirable to provide an integrated substrate/active agent cleansing article which provides for efficient utilization of the active agents.

It would be further desirable to provide such a cleansing article which provides for ease of activation to release and deliver the active agent.

SUMMARY OF THE INVENTION

The present invention relates to cleansing articles that are supplied in a dry state but are capable of releasing significant amount of liquid upon activation by the end user. In particular, the invention relates to a cleansing article, which comprises:

(a) an activation web having a first surface having one or more regions that exhibit a textured, three-dimensional surface topography and a second surface, the activation web having a ratio of wet caliper to dry caliper (resilience ratio) of at least about 0.9; and (b) a multi-phase, multi-component emulsion that is in direct contact with the first surface of the activation web.

During use, the textured activation web facilitates the breakage of the continuous external phase of the emulsion and releases the polar internal phase for the desired use.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

A. Definitions

As used herein, the term "comprising" means that the various components, ingredients, or steps, can be conjointly employed in practicing the present invention. Accordingly, the term "comprising" encompasses the more restrictive terms "consisting essentially of" and "consisting of."

As used herein, the terms "detergent", "detersive surfactant" and "detergent surfactant" are used interchangeably, and refer to any substance that reduces the surface tension of water, specifically a surface-active agent which concentrates at oil-water interfaces, exerts emulsifying action, and thus aids in removing soils.

As used herein, the term "polar" refers to a molecule that possesses a dipole moment, i.e., a molecule of which the positive and negative electrical charges are permanently separated, as opposed to a nonpolar molecule in which the charges coincide. A "polar liquid" is a liquid comprising one or more polar constituents.

As used herein, the terms "activate" and "activation" refer to the breakage of the continuous external phase of the emulsion and the release of the internal phase thereof.

All percentages, ratios and proportions used herein are by weight unless otherwise specified.

B. Structure of Representative Article

Figure 1:
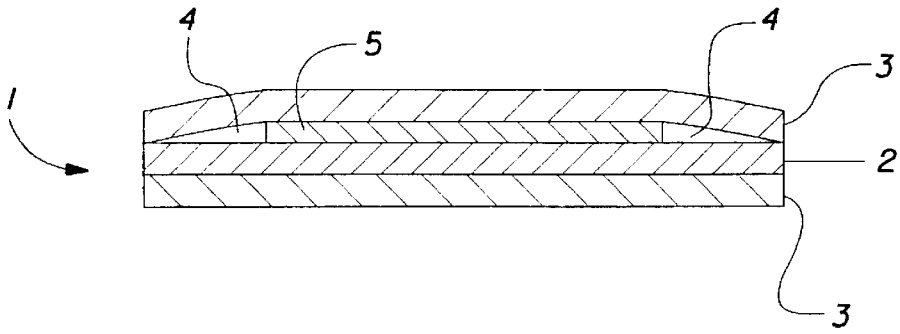
FIG. 1 is an elevation sectional view of a preferred embodiment of a cleaning article in accordance with the present invention.

FIG. 1 depicts a presently preferred embodiment of a cleansing article in accordance with the present invention. More particularly, FIG. 1 depicts a cleansing article 1 which includes an activation web 2, a first secondary web 3 peripherally joined with the activation web 2 to define an internal zone 4, and a multi-phase, multi-component emulsion 5 which at least partially occupies the internal zone 4. A second secondary web 3' forms the other surface of the wipe in its final form. The activation web 2 and first secondary web 3 are preferably substantially unbonded inwardly of their peripheries so as to permit some degree of lateral relative movement between them in response to externally-applied shearing forces, as will be discussed in greater detail hereafter.

As utilized herein, the term "activation web" refers to a web of sheet-like materials which are structured to provide an activation property when utilized in direct contact with a multi-phase, multi-component emulsion during use. By activation property, it is meant that the activation web functions to disrupt the external phase of the emulsion to release the internal liquid phase. This allows for transfer of at least one of the emulsion phases (preferably the liquid internal phase) from the article. "Secondary webs", on the other hand, are referred to herein as webs which form other surfaces or elements of cleansing articles according to the present invention and lack either (i) direct contact with the multi-phase, multi-component emulsion during use, (ii) activation properties, or both.

The multi-phase, multi-component emulsion 5 may be provided in the form of a uniformly-distributed layer or may be regionally or zonally applied as depicted in FIG. 1. The multi-phase, multi-component emulsion may be applied as one unitary deposition or may be progressively applied as multiple thin layers, or even regionally applied sequentially rather than simultaneously. The emulsion is preferably applied to at least one of the activation web or the secondary web before the article is assembled, although other means of introducing the emulsion into the article are also contemplated as being within the scope of the present invention. For discussion purposes, particularly with regard to methods and apparatus for manufacturing articles in accordance with the present invention, the web to which the emulsion is initially applied may be referred to as a "carrier web".

The individual elements or components of the cleansing article depicted in FIG. 1 will be described in greater detail in succeeding sections.

C. Composition of Multi-Phase, Multi-Component Emulsion

The articles of the present invention comprise an emulsion that is applied to a carrier substrate. This emulsion comprises: (1) a lipid phase; (2) an internal polar phase dispersed in the lipid phase; and (3) an emulsifier that forms the emulsion when the lipid phase is liquid;. In particular, the emulsion comprises:

(1) from about 2 to about 60% of a continuous, solidified lipid phase comprising a waxy lipid material having a melting point of about 30° C. or higher;

(2) from about 39 to about 97% of an internal polar phase dispersed in the lipid phase; and (3) an effective amount of an emulsifier capable of forming the emulsion when the lipid phase is in a fluid state.

Because the internal phase contains a high level of one or more polar liquids, this emulsion is typically referred to as a "high internal phase inverse emulsion". The continuous lipid phase is quite brittle at ambient temperatures such that the emulsion ruptures and releases the internal polar phase when subjected to low shear during use, e.g., wiping of the skin or other surface.

The continuous lipid phase should also be stable at ambient temperatures so that it stabilizes the emulsion structure of the present invention. In particular, this continuous lipid phase keeps the dispersed internal polar phase from being prematurely released prior to use of the article, such as during the rigors of processing.

The continuous lipid phase can comprise from about 2 to about 60% of the emulsion of the present invention. Preferably, this continuous lipid phase will comprise from about 5 to about 30% of the emulsion. Most preferably, this lipid phase will comprise from about 6 to about 15% of the emulsion.

The major constituent of this continuous lipid phase is a waxy lipid material. This lipid material is characterized by a melting point of about 30° C. or higher, i.e., is solid at ambient temperatures. Preferably, this lipid material has a melting point of about 40° C. or higher, more preferably about 50° C. or higher. Typically, this lipid material has a melting point in the range of from about 400 to about 80° C., more typically in the range of from about 50° to about 80° C., still more typically in the range of from about 60° to about 70° C.

The lipid material is solid at ambient temperatures and fluid or plastic at those temperatures at which the high internal phase inverse emulsion is applied to the carrier substrate. It is also desirable that the lipid material is stable (i.e., minimal coalescence of the emulsion droplets). for extended periods of time at elevated temperatures (e.g., about 50° C. or higher) that are normally encountered during storage and distribution of the articles of the present invention. This lipid material also needs to be sufficiently brittle at the shear conditions of use of the article such that it ruptures and releases the dispersed internal polar phase. These lipid materials should also desirably provide a good feel to the skin when used in personal care products such as wet-like cleansing wipes used in perianal cleaning.

Suitable lipid materials for use in the high internal phase inverse emulsion of the present invention include natural and synthetic waxes, as well as other oil soluble materials having a waxy consistency. As used herein, the term "waxes" refers to organic mixtures or compounds that are generally water-insoluble and tend to exist as amorphous or microcrystalline solids at ambient temperatures (e.g., at about 25° C.). Suitable waxes include various types of hydrocarbons, as well as esters of certain fatty acids (e.g., saturated triglycerides) and fatty alcohols. They can be derived from natural sources (i.e., animal, vegetable or mineral) or can be synthesized. Mixtures of these various waxes can also be used.

Some representative animal and vegetable waxes that can be used in the present invention include beeswax, carnauba, spermaceti, lanolin, shellac wax, candelilla, and the like. Particularly preferred animal and vegetable waxes are beeswax, lanolin and candelilla. Representative waxes from mineral sources that can be used in the present invention include petroleum-based waxes such as paraffin, petrolatum and microcrystalline wax, and fossil or earth waxes such as white ceresine wax, yellow ceresine wax, white ozokerite wax, and the like. Particularly preferred mineral waxes are petrolatum, microcrystalline wax, yellow ceresine wax, and white ozokerite wax. Representative synthetic waxes that can be used in the present invention include ethylenic polymers such as polyethylene wax, chlorinated naphthalenes such as "Halowax," hydrocarbon type waxes made by Fischer-Tropsch synthesis, and the like. Particularly preferred synthetic waxes are polyethylene waxes.

Besides the waxy lipid material, the continuous lipid phase can include minor amounts of other lipophilic or lipid-miscible materials. These other lipophilic/lipid-miscible materials are typically included for the purpose of stabilizing the emulsion to minimize loss of the internal polar phase or improving the aesthetic feel of the emulsion on the skin. Suitable materials of this type that can be present in the continuous lipid phase include hot melt adhesives such as Findley 193-336 resin, long chain alcohols such as cetyl alcohol, stearyl alcohol, and cetaryl alcohol, water-insoluble soaps such as aluminum stearate, silicone polymers such as polydimethylsiloxanes, hydrophobically modified silicone polymers such as phenyl trimethicone, and the like. Other suitable lipophilic/lipid miscible materials include polyol polyesters. By "polyol polyester" is meant a polyol having at least 4 ester groups. By "polyol" is meant a polyhydric alcohol containing at least 4, preferably from 4 to 12, and, most preferably from 6 to 8, hydroxyl groups. Polyols include monosaccharides, disaccharides and trisaccharides, sugar alcohols and other sugar derivatives (e.g., alkyl glycosides), polyglycerols (e.g., diglycerol and triglycerol), pentaerythritol, and polyvinyl alcohols. Preferred polyols include xylose, arabinose, ribose, xylitol, erythritol, glucose, methyl glucoside, mannose, galactose, fructose, sorbitol, maltose, lactose, sucrose, raffinose, and maltotriose. Sucrose is an especially preferred polyol. With respect to the polyol polyesters useful herein, it is not necessary that all of the hydroxyl groups of the polyol be esterified, however disaccharides polyesters should have no more than 3, and more preferably no more than 2 unesterified hydroxyl groups. Typically, substantially all (e.g., at least about 85%) of the hydroxyl groups of the polyol are esterified. In the case of sucrose polyesters, typically from about 7 to 8 of the hydroxyl groups of the polyol are esterified.

By "liquid polyol polyester" is meant a polyol polyester from the hereinbefore described groups having a liquid consistency at or below about 37° C. By "solid polyol polyester" is meant a polyol polyester from the hereinbefore described groups having a plastic or solid consistency at or above about 37° C. Liquid polyol polyesters and solid polyol polyesters may be successfully employed as emollients and immobilizing agents, respectively, in emulsions of the present invention. In some cases, solid polyol polyesters may also provide some emolliency functionality.

Typically, the major component of the high internal phase inverse emulsions of the present invention is the dispersed internal polar phase. This internal phase can provide a number of different benefits when released. In preferred embodiments, the polar phase will contain a significant percentage of water. For example, in preferred wet-like cleaning wipes for perianal cleaning, the internal polar phase will comprise a significant level of water, this released internal water phase that provides the primary cleansing action for these wipes. In these preferred embodiments, the polar phase will contain a significant percentage of water, preferably at least about 60%, by weight of the internal polar phase, more preferably at least about 75%, by weight, still more preferably at least about 85%, by weight.

The internal polar phase can comprise from about 39 to about 97% of the emulsion of the present invention. Preferably, this internal polar phase will comprise from about 67 to about 92% of the emulsion. Most preferably, this polar phase will comprise from about 82 to about 91% of the emulsion.

In preferred embodiments, where the internal phase comprises significant amounts of water, this internal polar phase can comprise other water-soluble or dispersible materials that do not adversely affect the stability of the high internal phase inverse emulsion. One such material that is typically included in the internal water phase is a water-soluble electrolyte. The dissolved electrolyte minimizes the tendency of materials present in the lipid phase to also dissolve in the water phase. Any electrolyte capable of imparting ionic strength to the water phase can be used. Suitable electrolytes include the water soluble mono-, di-, or trivalent inorganic salts such as the water-soluble halides, e.g., chlorides, nitrates and sulfates of alkali metals and alkaline earth metals. Examples of such electrolytes include sodium chloride, calcium chloride, sodium sulfate, magnesium sulfate, and sodium bicarbonate. The electrolyte will typically be included in a concentration in the range of from about 1 to about 20% of the water phase.

Other water-soluble or dispersible materials that can be present in the internal water phase include thickeners and viscosity modifiers. Suitable thickeners and viscosity modifiers include water-soluble polyacrylic and hydrophobically modified polyacrylic resins such as Carbopol and Pemulen, starches such as corn starch, potato starch, tapioca, gums such as guar gum, gum arabic, cellulose ethers such as hydroxypropyl cellulose, hydroxyethyl cellulose, carboxymethyl cellulose, and the like. These thickeners and viscosity modifiers will typically be included in a concentration in the range of from about 0.05 to about 0.5% of the water phase.

Other water-soluble or dispersible materials that can be present in the internal water phase include polycationic polymers to provide steric stabilization at the water-lipid interface and nonionic polymers that also stabilize the water-in-lipid emulsion. Suitable polycationic polymers include Reten 201, Kymene® 557H and Acco 711. Suitable nonionic polymers include polyethylene glycols (PEG) such as Carbowax. These polycationic and nonionic polymers will typically be included in a concentration in the range of from about 0.1 to about 1.0% of the water phase.

In addition or alternative to containing water, the internal polar phase may comprise polar materials, including solvents such as ethanol, isopropanol, butanol and hexanol; glycols or substituted glycols such as propylene glycol, butylene glycol, 2,2,4-trimethylpentane-1,3-diol or hexylene glycol; polyglycols such as diethylene glycol or triethylene glycol; glycol ethers such as short chain (e.g., $C_1$–$C_6$) derivatives of oxyethylene glygol and oxypropylene glycol, such as mono- and di-ethylene glycol n-hexyl ether, mono-, di- and tri-propylene glycol n-butyl ether; and the like. Also, solvents such as tetrahydrofuran, dimethyl sulfoxide, acetone and the like may be included in the internal polar phase.

Another key component of the high internal phase inverse emulsion of the present invention is an emulsifier. In the emulsions of the present invention, the emulsifier is included in an effective amount. What constitutes an "effective amount" will depend on a number of factors including the respective amounts of the lipid and internal polar phase components, the type of emulsifier used, the level of impurities present in the emulsifier, and like factors. Typically, the emulsifier comprises from about 1 to about 10% of the emulsion. Preferably, this emulsifier will comprise from about 3 to about 6% of the emulsion. Most preferably, this emulsifier will comprise from about 4 to about 5% of the emulsion. While the singular "emulsifier" is used to describe this component, more than one emulsifier may be used when forming the emulsion. Indeed, as discussed below, it may be desirable to utilize both a primary and a secondary emulsifier when certain materials are employed. Though not intended to limit the scope of the invention, where two emulsifiers are utilized, preferred is where the primary emulsifier comprises from about 1 to about 7%, more preferably from about 2 to about 5%, most preferably from about 2 to about 4%, by weight of the emulsion; and the secondary emulsifier comprises from about 0.5 to about 3%, more preferably from about 0.75 to about 2%, most preferably from about 0.75 to about 1.5%, by weight of the emulsion.

This emulsifier needs to be substantially lipid-soluble or miscible with the lipid phase materials, especially at the temperatures at which the lipid material melts. It also should have a relatively low HLB value, to facilitate formation of the requisite inverse emulsion. Emulsifiers suitable for use in the present invention have HLB values typically in the range of from about 2 to about 5 and can include mixtures of different emulsifiers. Preferably, these emulsifiers will have HLB values in the range of from about 2.5 to about 3.5.

Emulsifiers suitable for use in the present invention include silicone polymer emulsifiers such as alkyl dimethicone copolyols (e.g., Dow Corning Q2–5200 laurylmethicone copolyol). Such emulsifiers are described in detail in co-pending U.S. patent application Ser. No. 08/430,061, filed Apr. 27, 1995 by L. Mackey (Case 5653) now abondoned, which is incorporated by reference herein.

Other suitable emulsifiers are described in co-pending U.S. patent application Ser. No. 08/336,456, filed November 9, 1994 by L. Mackey et al. (Case 5478) now abondoned, which is incorporated by reference herein. Emulsifiers described therein include certain sorbitan esters, preferably the sorbitan esters of $C_{16}$–$C_{22}$ saturated, unsaturated or branched chain fatty acids. Because of the manner in which they are typically manufactured, these sorbitan esters usually comprise mixtures of mono-, di-, tri-, etc. esters. Representative examples of suitable sorbitan esters include sorbitan monooleate (e.g., SPAN® 80), sorbitan sesquioleate (e.g., Arlacel® 83), sorbitan monoisostearate (e.g., CRILL® 6 made by Croda), sorbitan stearates (e.g., SPAN® 60), sorbitan triooleate (e.g., SPAN® 85), sorbitan tristearate (e.g., SPAN® 65) and sorbitan dipalmitates (e.g., SPAN® 40). Laurylmethicone copolyol is a particularly preferred emulsifier for use in the present invention. Other suitable emulsifiers described therein include certain glyceryl monoesters, preferably glyceryl monoesters of $C_{16}$–$C_{22}$ saturated, unsaturated or branched chain fatty acids such as glyceryl monostearate, glyceryl monopalmitate, and glyceryl monobehenate; certain sucrose fatty acid esters, preferably sucrose esters of the $C_{12}$–$C_{22}$ saturated, unsaturated, and branched chain fatty acids such as sucrose trilaurate and sucrose distearate (e.g., Crodesta® F10), and certain polyglycerol esters of $C_{16}$–$C_{22}$ saturated, unsaturated or branched fatty acids such as diglycerol monooleate and tetraglycerol monooleate.

In addition to these primary emulsifiers, coemulsifiers can be used to provide additional water-in-lipid emulsion stability. Suitable coemulsifiers include phosphatidyl cholines and phosphatidyl choline-containing compositions such as the lecithins; long chain $C_{16}$–$C_{22}$ fatty acid salts such as sodium stearate, long chain $C_{16}$–$C_{22}$ dialiphatic, short chain $C_1$–$C_4$ dialiphatic quaternary ammonium salts such as ditallow dimethyl ammonium chloride and ditallow dimethyl ammonium methylsulfate; long chain $C_{16}$–$C_{22}$ dialkoyl (alkenoyl)-2-hydroxyethyl, short chain $C_1$–$C_4$ dialiphatic quaternary ammonium salts such as ditallowoyl-2-hydroxyethyl dimethyl ammonium chloride, the long chain $C_{16}$–$C_{22}$ dialiphatic imidazolinium quaternary ammonium salts such as methyl-1-tallow amido ethyl-2-tallow imidazolinium methylsulfate and methyl-1-oleyl amido ethyl-2-oleyl imidazolinium methylsulfate; short chain $C_1$–$C_4$ dialiphatic, long chain $C_{16}$–$C_{22}$ monoaliphatic benzyl quaternary ammonium salts such as dimethyl stearyl benzyl ammonium chloride, and synthetic phospholipids such as stearamidopropyl PG-dimonium chloride (Phospholipid PTS from Mona Industries). Interfacial tension modifiers such as cetyl and stearyl alcohol for closer packing at the water-lipid interface can also be included.

Other emulsifiers useful in making the articles of the present invention include the high viscosity emulsifiers described in co-pending U.S. patent application Ser. No. 08/640,268, filed Apr. 30, 1996 by L. Mackey and B. Hird now abandoned, which is incorporated by reference herein. These emulsifiers preferably have a viscosity at 55° C. of at least about 500 centipoise. (Viscosity can be measured using a Lab-Line Instruments Brookfield-type rotating disc viscometer.) That application describes the use of emulsifiers such as those designated by The Lubrizol Corporation (Wickliffe, OH) as OS-122102, OS-121863, OS-121864, OS-80541J and OS-80691J, which are reaction products of (i) a hydrocarbyl-substituted carboxylic acid or anhydride (preferably a polyisobutylene-substituted succinic acid or anhydride); and (ii) an amine or alcohol, to form an ester or amide product. The materials, and methods for their manufacture, are described in U.S. Pat. No. 4,708,753, issued Nov. 24, 1987 to Forsberg [see especially Column 3, lines 32–38; and Column 8, line 10, to Column 26, line 68], and U.S. Pat. No. 4,844,756, issued Jul. 4, 1989 to Forsberg, both of which are incorporated by reference herein.

Other materials believed to be useful in the present invention include hydrocarbon-substituted succinic anhydrides such as those described in U.S. Pat. No. 3,215,707, issued Nov. 2, 1965 to Rense; U.S. Pat. No. 3,231,587, issued Jan. 25, 1996 to Rense; U.S. Pat. No. 5,047,175, issued to Forsberg on Sep. 10, 1991; and World Patent Publication Number WO 87/03613, published by Forsberg on Jun. 18, 1987. These publications are all incorporated by reference herein.

Still other materials useful as the emulsifier, particularly as a co-emulsifier with a high viscosity primary emulsifier, are ABA block copolymers of 12-hydroxystearic acid and polyethylene oxide. Such materials are described in U.S. Pat. No. 4,875,927, issued to T. Tadros on Oct. 24, 1989, which is incorporated by reference herein. A representative material of this class useful as an emulsifier herein is available from Imperial Chemical Industries PLC as Arlacel P135.

As indicated, while all the above-described materials may be used as a single emulsifier, it may be desired to employ more than one emulsifier when forming the emulsion. In particular, where a high viscosity emulsifier is used, a certain "tacky" feel may result when the treated article is subjected to in-use shear pressures that break the emulsion. In this case, it may be desirable to use a relatively lower viscosity co-emulsifier with the primary emulsifier, to allow use of a lower amount of the main emulsifier, thereby alleviating tackiness. In one embodiment of the present invention, a primary emulsifier available from Lubrizol (i.e., reaction product of polyisobutylene-substituted succinic acid and an amine) and a secondary emulsifier that is an ABA block copolymer of poly-12-hydroxystearic acid and polyethylene oxide (e.g., ICI's Arlacel P135) are used to provide an emulsion with beneficial water retention levels over time, as well as beneficial reduced tackiness (via reduction in level of primary emulsifier). The skilled artisan will recognize that different desired end-uses and product designs will dictate whether multiple emulsifiers are appropriate, and the appropriate relative amounts of each if appropriate. Such a determination will require only routine experimentation by the skilled artisan in view of the present disclosure.

The high internal phase inverse emulsions of the present invention can also comprise other optional components typically present in moisture containing emulsions of this type. These optional components can be present in either the continuous lipid phase or the internal polar phase and include perfumes, antimicrobial (e.g., antibacterial) actives, pharmaceutical actives, deodorants, opacifiers, astringents, skin conditioners, cosmetics, cleansers, surface conditioners, insect repellents, pH buffers, and the like, as well as mixtures of these components. All of these materials are well known in the art as additives for such formulations and can be employed in effective, appropriate amounts in the emulsions of the present invention. A particularly preferred optional component that is included the emulsions of wet-like cleansing wipes according to the present invention is glycerin as a skin conditioning agent.

The emulsion component of the articles of the present invention is described and claimed herein in terms of components (i.e., lipid phase components, internal polar phase components, emulsifier components, etc.), and corresponding amounts of these components, that are present after emulsion formation. That is, when the stable emulsion is formed and applied to the carrier. It is understood, however, that the description (components and amounts) of the emulsion also encompasses emulsions formed by combining the described components at the described levels, regardless of the chemical identity of the components after emulsification and application to the carrier.

D. Activation Webs

In accordance with the present invention, the cleansing article also comprises a sheet of material forming an activation web to aid in the release of a liquid from the multi-phase, multi-component emulsion when "activated" by a user.

In order to "activate" the multi-phase, multi-component emulsion, two physical properties in combination have been found to enhance the efficacy of such cleansing articles by improving the degree of breakage the continuous phase of the emulsion and improving the delivery of the active portion of the emulsion from within the article to the outer surface where it may be effectively utilized for its intended function.

One property which has been found to be important in the activation webs of the present invention is a textured surface on the side, or a portion thereof, of the activation web which directly contacts the multi-phase, multi-component emulsion during use. By "textured", it is meant that the surface of the web has extensions beyond the two-dimensional plane defined by the macroscopic web. In other words, the activation web comprises a surface having three-dimensionality. Without intending to be bound, Applicants hypothesize such a surface provides a degree of abrasiveness to the web surface to aid in providing a frictional activation property to break up the continuous external lipid phase and to release the internal liquid phase from the emulsion. Varying degrees of abrasion may be provided by appropriately selecting the activation web material and the surface geometry. However, the activation web should preferably allow for sufficient relative lateral movement between the activation web and the overlying optional secondary web so as to provide a shearing action upon the multi-phase emulsion to aid in the release of the internal liquid phase.

Another property which has been found to be important in the activation webs of the present invention is resiliency. Activation webs in accordance with the present invention should exhibit a resilient property, at least for a time period corresponding to the typical use period for the article, which enables the webs to retain their textured or three-dimensional character during activation of the emulsion. For purposes of the present invention, resiliency of the activation web is described in terms of its wet caliper to dry caliper ratio (hereafter referred to as "resilience ratio"). Wet resiliency is measured in accordance with the procedure described in the Test Method section below. The activation webs of the present invention will have a resilience ratio of at least about 0.9. Preferably, the activation webs will have a resilience ratio of at least about 0.95, more preferably at least about 0.98. As indicated, the activation web should have the requisite resilience ratio for a time period corresponding to the typical use period of the article. Thus, the activation web need not exhibit the requisite resilience ratio indefinitely. As discussed below, in certain embodiments, the activation web will comprise a synthetic material (e.g., a polymeric network) printed on a cellulosic material. It is apparent that while the cellulosic component of the activation member may collapse (i.e., will not be resilient) to some degree when wet, the polymeric network will retain its three-dimensional, textured character and will provide the desired activation of the emulsion. In such embodiments, the resilience ratio will be adjusted to exclude the reduced resiliency caused solely by the cellulosic component.

In addition to providing abrasive character via a textured surface and exhibiting the requisite resilience ratio, the textured surface of the activation web, in direct contact with the multi-phase, multi-component emulsion during use, will preferably provide a significant amount of built-in void volume which is accessible to the emulsion. This void volume provides a containment space to capture and retain the solid phase of the emulsion when it is separated from the active liquid phase during the activation process, such that this portion of the emulsion does not interfere with the delivery or functioning of the liquid phase and/or leave the cleansing article where it may contaminate external surfaces during use.

Another property which has been found to provide optional desirable attributes in cleansing articles in accordance with the present invention is permeability. In accordance with the present invention the activation web need not be permeable and may in fact be liquid-impermeable, at least to the liquid forming the multi-phase, multi-component emulsion. In such an embodiment, the activation web would form a barrier and ensure that the released liquid remains on one side of the activation web. However, a liquid-permeable activation web allows the liquid to penetrate the activation web and, depending upon the construction of the overall cleansing article, wet the outer layer(s) of the article on both opposing sides of the activation web for use as desired.

For activation webs which are permeable, an additional property which is believed to be advantageous for certain applications is capillarity. With the liquid characteristics of the particular liquid component of the multi-phase, multi-component emulsion taken into account, the activation web may be provided with liquid passageways extending from one surface to the other surface which act as capillary structures for the particular liquid utilized. Accordingly, the activation web may provide a preferential liquid flow direction to direct liquid from one side of the activation web to the other side of the activation web. Such a liquid motive force also tends to resist liquid flow in the opposite direction. Such capillary properties may be utilized for several functions, such as providing a one-sided cleansing article wherein one side becomes wetted by the liquid to provide an active cleansing surface, while the other side remains substantially un-wetted by the liquid within.

In addition, it has been found to be advantageous to utilize an activation web comprising a thermoplastic material. Such materials, while not essential to the present invention, provide an additional benefit over and above those provided by non-thermoplastic materials in that such a web provides a material which may be readily thermally bonded to other cleansing article components such as non-thermoplastic secondary webs in the absence of adhesives and other bonding agents.

One material suitable for use in accordance with the present invention comprises a three-dimensional, macroscopically-expanded, formed film web of a polymeric material, such as polyethylene, polypropylene, or other suitable material, as a carrier for the emulsion. Apertured formed films are preferred because they are pervious to liquids and yet non-absorbent and also have a tendency to exhibit preferential liquid flow in one direction. Suitable formed films are described in U.S. Pat. No. 3,929,135, issued to Thompson on Dec. 30, 1975; U.S. Pat. No. 4,324,246 issued to Mullane, et al. on Apr. 13, 1982; U.S. Pat. No. 4,342,314 issued to Radel. et al. on Aug. 3, 1982; U.S. Pat. No. 4,463,045 issued to Ahr et al. on Jul. 31, 1984; 4,637,819 issued to Ouellette, et al. on Jan. 20, 1987, and U.S. Pat. No. 5,006,394 issued to Baird on Apr. 9, 1991. Each of these patents are incorporated herein by reference. Other suitable formed films include hydroformed films such as those disclosed in U.S. Pat. No. 4,629,643, issued Dec. 16, 1986 to Curro et al., and U.S. Pat. No. 4,609,518, issued Sep. 2, 1986 to Curro, both of which are also hereby incorporated herein by reference. The formed films would preferably have microapertures formed therein.

Figure 2:
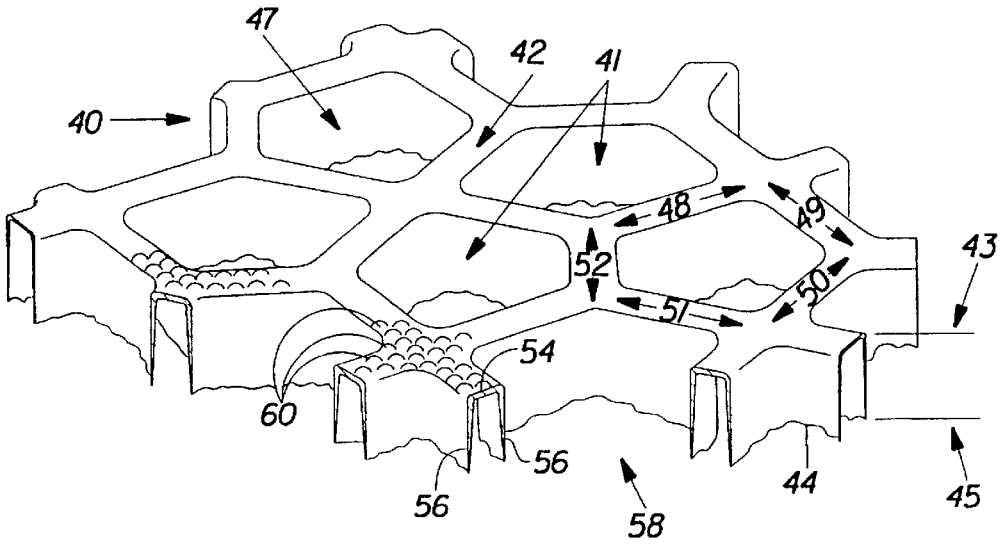
FIG. 2 is an enlarged, partially segmented, perspective illustration of a preferred three-dimensional, macroscopically-expanded formed film web suitable for use as an activation web in a cleaning article according to the present invention.

FIG. 2 is an enlarged, partially segmented, perspective illustration of a particularly preferred embodiment of an apertured, macroscopically expanded, three-dimensional, fiber-like, liquid pervious, polymeric web 40, generally in accordance with the teachings of commonly assigned U.S. Pat. No. 4,342,314 issued to Radel et al. on Aug. 3, 1982, which has been found suitable for use as a topsheet of absorbent articles. The term "macroscopically expanded", when used to describe three-dimensional plastic webs of the present invention, refers to webs, ribbons and films which have been caused to conform to the surface of a three-dimensional forming structure so that both surfaces thereof exhibit a three-dimensional forming pattern of surface aberrations corresponding to the macroscopic cross-section of the forming structure, the surface aberrations comprising the pattern are individually discernible to the normal naked eye, i.e., a normal naked eye having 20/20 vision unaided by an instrument that changes the apparent size or distance of an object or otherwise alters the visual powers of the eye, when the perpendicular distance between the viewer's eye and the plane of the web is about 12 inches. The term "fiber-like", as utilized herein to describe the appearance of plastic webs of the present invention, refers generally to any fine scale pattern of apertures, random or non random, reticulated or non-reticulated, which connote an overall appearance and impression of a woven or nonwoven fibrous web when viewed by the human eye.

As can be seen in FIG. 2, theweb's fiber-like appearance is comprised of a continuum of fiber-like elements, the opposed ends of each of the fiber-like elements are interconnected to at least one other of the fiber-like elements. In the embodiment disclosed in FIG. 2, the interconnected fiber-like elements form a pattern network of pentagonally shaped capillaries 41. The web 40 which exhibits a fiber-like appearance, embodies a three-dimensional microstructure extending from the webs first surface 42 in plane 43 to its second surface 44 in plane 45 which in absorbent articles is used to promote rapid liquid transport from the first surface 42 to the second surface 44 of the web without lateral transmission of liquid between adjacent capillaries 41. As utilized herein, the term "microstructure" refers to a structure of such fine scale that its precise detail is readily perceived by the human eye only upon magnification by microscopic or other means well known in the art.

Apertures 47 in the first surface 42 are formed by a multiplicity of intersecting fiber-like elements, e.g., elements 48, 49, 50, 51, and 52, interconnected to one another in the body facing surface of the web. Each fiber-like element comprises a base portion, e.g., base portion 54, located in plane 43. Each base portion has a sidewall portion, e.g., sidewall portions 56, attached to each edge thereof. The sidewall portions 56 extend generally in the direction of the second surface 44 of the web. The intersecting sidewall portions of the fiber-like elements are interconnected to one another intermediate the first and second surfaces of the web and terminate substantially concurrently with one another in the plane 45 of the second surface.

In the particularly preferred embodiment shown in FIG. 2, the interconnected sidewall portions 56 terminate substantially concurrently with one another in the plane 45 of the second surface 44 to form apertures 58 in the second surface 44 of the web. The network of capillaries 41 formed by the interconnected sidewall portions 56 between apertures 47 and 58 allows for free transfer of liquids from the uppermost surface of the web directly to the lowermost surface of the web without lateral transmission of the liquid between adjacent capillaries.

The base portion 54 may include a microscopic pattern of surface aberrations 60, generally in accordance with the teachings of commonly assigned U.S. Pat. No. 4,463,045 issued to Ahr et al. on Jul. 31, 1984. When utilized in a viewable configuration, the microscopic pattern of surface aberrations 60 provide a substantially non-glossy visible surface when the web 40 is struck by incident light rays.

When utilized as an activation web as shown in the embodiment of FIG. 1, the formed film web of FIG. 2 may be employed with the first surface 42 facing and directly contacting the multi-phase, multi-component emulsion 5. However, it is presently preferred to utilize the second surface 44 as the surface directly contacting the emulsion during use. In such a configuration, the three-dimensional nature of the formed film with its unevenly ruptured apertures 58 in the second surface provide a heightened abrasive property in comparison with the first surface so as to provide an enhanced activation property in accordance with the present invention.

Accordingly, such a material when utilized as an activation web in accordance with the present invention (i) provides a three-dimensional surface topography on the side of the material which initially directly contacts the multi-phase, multi-component emulsion during use, (ii) provides three-dimensional void volume accessible to the emulsion, (iii) is wet resilient, (iv) comprises a capillary structure, and (v) provides a heat sealable material useful in assembling the cleansing article.

In addition to utilizing thermoplastic films as activation webs, relatively untextured webs can be modified in such a way as to significantly increase the amount of texture that will contact the emulsion and thereby improve the fluid delivery performance of the article. One particular method for modifying such an untextured web is to print on a more textured element to a relatively untextured web. The printed component may cover the entire surface or only a portion of the surface in contact with the emulsion. Potential embodiments include, for example, printed polymer networks, unbonded particles or particles adhered to the substrate, printed polymeric "hooks", which are described in detail in U.S. Pat. Nos. 5,230,851, 5,318,741, 5,058,247, 5,116,563, 5,180,534, 5,540,673, 5,326,415, 5,325,569, 5,392,498, 5,300,058, 5,385,706, 5,397,317, and 5,586,979, the disclosure of each of which is incorporated by reference herein. It will be understood by one skilled in the art that this technique may be applied to any of a wide variety of substrates such that the overall resilience ratio of the material is increased and the overall texture in contact with the emulsion has been augmented. For the purpose of this invention, any modified web, as herein described, will require that the calculation of the wet resilience ratio be modified as described in the Test Method section below.

In one particular such embodiment, the activation web may be in the form of a polymer network printed on a substrate (e.g., a cellulosic substrate) in a predetermined bonding pattern to provide a plurality of textured, three-dimensional regions on the substrate. An embodiment of such an activation web is depicted generally in FIG. 4A as web 200. Web 200 comprises a substrate 114 having printed thereon a polymer, which is designated as 110.

Figure 4A:
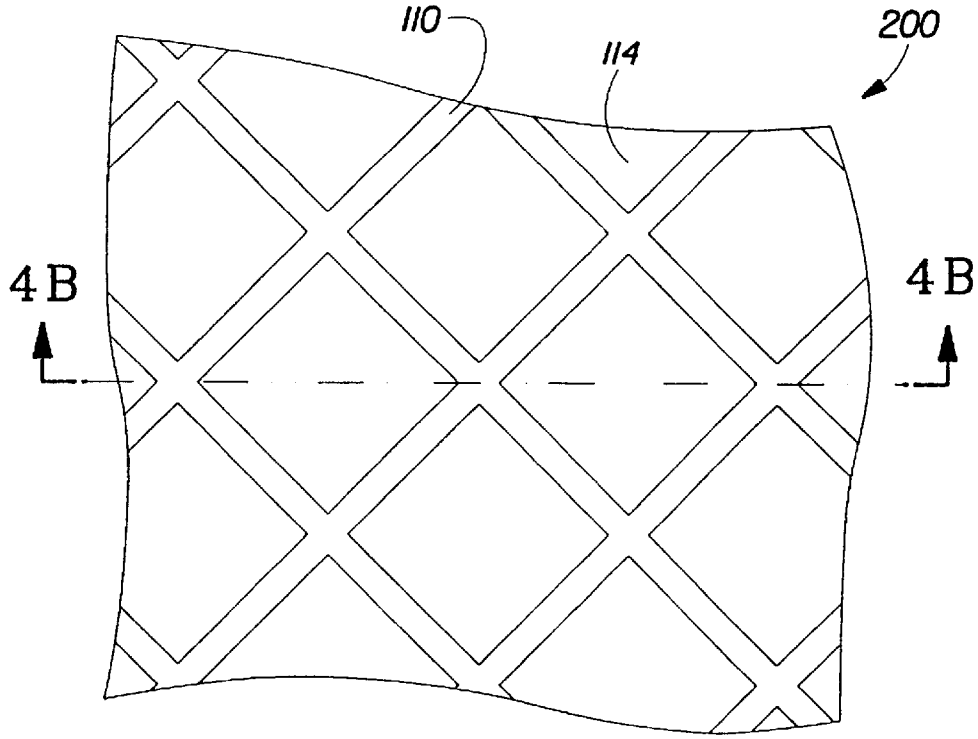
FIG. 4A is a plan view illustration of one embodiment of an activation web useful in the articles of the present invention, the activation web comprising a continuous network of a polymeric material printed on a substrate.
Figure 4B:
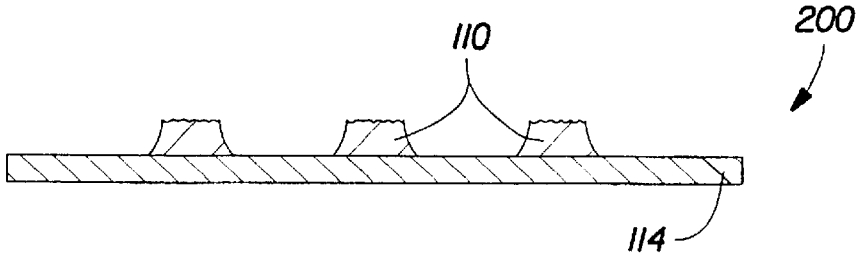
FIG. 4B is a cross-sectional illustration of the activation web shown in FIG. 4A, taken along the direction indicated by line 4—4. The figure illustrates the three-dimensional, textured surface resulting from printing of polymer on the substrate to form the activation web.

In this preferred embodiment, adhesive 110 is applied to substrate 114 by screen printing an adhesive in a lattice pattern generally as shown in FIG. 4A. A suitable screen for this embodiment is a 40 mesh Galvano screen manufactured by Rothtec Engraving Corp., New Bedford, Mass. One suitable adhesive is a hot melt adhesive commercially available as H1382-01 from Ato-Findley Adhesives of Wauwatosa, Wis. A suitable screen printer is available from ITW Dynatec, Model SP-117.

The adhesive is preferably water insoluble so that the printed structure maintains its geometric integrity when wetted. The adhesive is preferably also surfactant tolerant. By "surfactant tolerant" it is meant that the bonding characteristics of the adhesive are not degraded by the presence of surfactants. Suitable adhesives include EVA (ethylene vinyl acetate) based hot melt adhesives.

Figure 3:
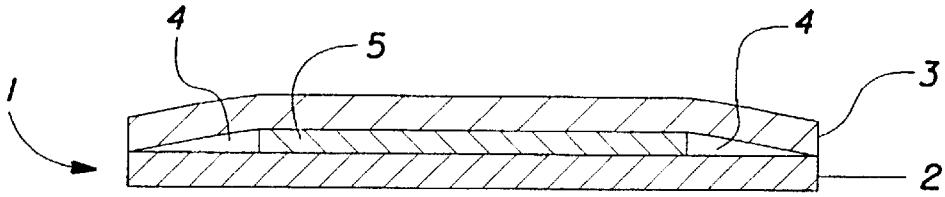
FIG. 3 is an elevation sectional view of another embodiment of a cleaning article in accordance with the present invention.

With further reference to FIG. 3, the hot melt adhesive can be applied to the substrate (e.g., cellulosic layer) 114 in a continuous network defining a discontinuous plurality of unbonded regions. In one preferred embodiment, as shown, the adhesive is applied as parallel, spaced apart lines in a first direction, intersected by parallel, spaced apart lines in a second direction. The intersecting lines define diamond-shaped patterns of unbonded regions in the activation web.

E. Secondarv Webs

The articles of the present invention may also comprise one or more secondary webs. Webs or sheet materials useful in the present invention as secondary webs in conjunction with the activation web (as shown in FIG. 1) to contain the multi-phase, multi-component emulsion prior to use can take a variety of substrate forms. Suitable substrates include woven materials, nonwoven materials, foams, sponges, battings, balls, puffs, films, and the like. Particularly preferred substrates for use in the present invention are nonwoven types. These nonwoven substrates can comprise any conventionally fashioned nonwoven sheet or web having suitable basis weight, caliper (thickness), absorbency and strength characteristics. Nonwoven substrates can be generally defined as bonded fibrous or filamentous products having a web structure, in which the fibers or filaments are distributed randomly as in "air-laying" or certain "wet-laying" processes, or with a degree of orientation, as in certain "wet-laying" or "carding" processes. The fibers or filaments of such nonwoven substrates can be natural (e.g., wood pulp, wool, silk, jute, hemp, cotton, linen, sisal or ramie) or synthetic (e.g., rayon, cellulose ester, polyvinyl derivatives, polyolefins, polyamides or polyesters) and can be bonded together with a polymeric binder resin. Examples of suitable commercially available nonwoven substrates include those marketed under the tradename Sontara® by DuPont and Polyweb® by James River Corp.

For reasons of cost, ease of manufacture and article disposability (e.g., flushability), the preferred type of nonwoven substrate used in wipes of the present invention comprise those made from wood pulp fibers, i.e., paper webs. As noted, paper webs can be prepared by either air-laying or wet-laying techniques. Air-laid paper webs such as Air Tex® SC130 are commercially available from James River Corp.

More conventionally, paper webs are made by wet-laying procedures. In such procedures, a web is made by forming an aqueous papermaking furnish, depositing this furnish onto a foraminous surface, such as a Fourdrinier wire, and by then removing water from the furnish, for example by gravity, by vacuum assisted drying and/or by evaporation, with or without pressing, to thereby form a paper web of desired fiber consistency. In many cases, the papermaking apparatus is set up to rearrange the fibers in the slurry of papermaking furnish as dewatering proceeds in order to form paper substrates of especially desirable strength, hand, bulk, appearance, absorbency, etc.

The papernaking furnish utilized to form the preferred paper web substrates for articles of the present invention essentially comprises an aqueous slurry of papermaking fibers (i.e., paper pulp) and can optionally contain a wide variety of chemicals such as wet strength resins, surfactants, pH control agents, softness additives, debonding agents and the like. Wood pulp in all its variations can be used to form the papermaking furnish. Wood pulps useful herein include both sulfite and sulfate pulps, as well as mechanical, thermo-mechanical and chemi-thermo-mechanical pulps, all of which are well known to those skilled in the papermaking art. Pulps derived from both deciduous or coniferous trees can be used. Preferably the papermaking furnish used to form the preferred paper web substrates for wipes of the present invention comprises Kraft pulp derived from northern softwoods.

A number of papermaking processes have been developed which utilize a papermaking apparatus that forms paper webs having particularly useful or desirable fiber configurations. Such configurations can serve to impart such characteristics of the paper web as enhanced bulk, absorbency and strength. One such process employs an imprinting fabric in the papermaking process that serves to impart a knuckle pattern of high density and low density zones into the resulting paper web. A process of this type, and the papermaking apparatus for carrying out this process, is described in greater detail in U.S. Pat. No. 3,301,746 (Sanford et al), issued Jan. 31, 1967, which is incorporated by reference.

Another papermaking process employs a throughdrying fabric having impression knuckles raised above the plane of the fabric. These impressions create protrusions in the throughdried sheet, and provide the sheet with stretch in the cross-machine direction. A process of this type is described in European Patent Publication No. 677,612A2, published Oct. 18, 1995 by G. Wendt et al., the disclosure of which is incorporated herein by reference.

Still another papermaking process carried out with a special papermaking apparatus, is one that provides a paper web having a distinct, continuous network region formed by a plurality of "domes" dispersed throughout the network region on the substrate. Such domes are formed by compressing an embryonic web as formed during the papermaking process into a foraminous deflection member having a patterned network surface formed by a plurality of discrete isolated deflection conduits in the deflection member surface. A process of this type, and apparatus for carrying out such a process, is described in greater detail in U.S. Pat. No. 4,529,480 (Trokhan), issued Jul. 16, 1985; U.S. Pat. No. 4,637,859 (Trokhan), issued Jan. 20, 1987; and; U.S. Pat. No. 5,073,235 (Trokhan), issued Dec. 17, 1991, all of which are incorporated by reference. Another type of papermaking process, and apparatus to carry it out that is suitable for making layered composite paper substrates is described in U.S. Pat. No. 3,994,771 (Morgan et al); issued Nov. 30, 1976, which is incorporated by reference.

Still another papermaking process carried out with a special papermaking apparatus is one that provides a paper web having multiple basis weight regions. Such a process is described in U.S. Pat. No. 5,245,025, issued Sep. 14, 1993 to Trokhan et al., U.S. Pat. No. 5,503,715, issued Apr. 2, 1996 to Trokhan et al., and U.S. Pat. No. 5,534,326, issued Jul. 9, 1996 to Trokhan et al., the disclosure of each of which is incorporated herein by reference. See also, co-pending U.S. patent application Ser. No. 08/886,764, filed by Nissing et al. on Jul. 1, 1997, now U.S. Pat. No. 6,133,166 the disclosure of which is incorporated by reference herein. Such substrates provide a carrier having regions that are more permeable (i.e., relatively lower basis weight regions) than other regions (i.e., higher basis weight regions).

In addition to papermaking fibers, the papermaking furnish used to make these paper web substrates can have other components or materials added thereto as can be or later become known in the art. The types of additives desirable will be dependent upon the particular end use of the tissue sheet contemplated. For example, in wipe products such as toilet paper, paper towels, facial tissues, baby wipes and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. For permanent wet strength generation, polyamide-epichlorohydrin resins are cationic wet strength resins that have been found to be of particular utility. Suitable types of such resins are described in U.S. Pat. No. 3,700,623 (Keim), issued Oct. 24, 1972, and U.S. Pat. No. 3,772,076 (Keim), issued Nov. 13, 1973, both of which are incorporated by reference. One commercial source of a useful polyamide-epichlorohydrin resin is Hercules, Inc. of Wilmington, Del., which markets such resins under the mark Kymene® 557H.

Polyacrylamide resins have also been found to be of utility as wet strength resins. These resins are described in U.S. Pat. Nos. 3,556,932 (Coscia et al), issued Jan. 19, 1971, and 3,556,933 (Williams et al), issued Jan. 19, 1971, both of which are incorporated by reference. One commercial source of polyacrylamide resins is American Cyanamid Co. of Stamford, Conn, which markets one such resin under the mark Parez® 631 NC.

Still other water-soluble cationic resins finding utility wet strength resins are urea formaldehyde and melamine formaldehyde resins. The more common functional groups of these polyfunctional resins are nitrogen containing groups such as amino groups and methylol groups attached to nitrogen. Polyethylenimine type resins can also find utility in the present invention. In addition, temporary wet strength resins such as Caldas 10 (manufactured by Japan Carlit), CoBond 1000 (manufactured by National Starch and Chemical Company), and Parez 750 (manufactured by American Cyanamide Co.) can be used in the present invention. It is to be understood that the addition of chemical compounds such as the wet strength and temporary wet strength resins discussed above to the pulp furnish is optional and is not necessary for the practice of the present invention.

In addition to wet strength additives, it can also be desirable to include in the papermaking fibers certain dry strength and lint control additives known in the art. In this regard, starch binders have been found to be particularly suitable. In addition to reducing linting of the paper substrate, low levels of starch binders also impart a modest improvement in the dry tensile strength without imparting stiffness that could result from the addition of high levels of starch. Typically the starch binder is included in an amount such that it is retained at a level of from about 0.01 to about 2%, preferably from about 0.1 to about 1%, by weight of the paper substrate.

In general, suitable starch binders for these paper web substrates are characterized by water solubility, and hydrophilicity. Although it is not intended to limit the scope of suitable starch binders, representative starch materials include corn starch and potato starch, with waxy corn starch known industrially as amioca starch being particularly preferred. Amioca starch differs from common corn starch in that it is entirely amylopectin, whereas common corn starch contains both amylopectin and amylose. Various unique characteristics of amioca starch are further described in "Amioca—The Starch From Waxy Corn," H. H. Schopmeyer, Food Industries, Dec. 1945, pp. 106–108 (Vol. pp. 1476–1478).

The starch binder can be in granular or dispersed form, the granular form being especially preferred. The starch binder is preferably sufficiently cooked to induce swelling of the granules. More preferably, the starch granules are swollen, as by cooking, to a point just prior to dispersion of the starch granule. Such highly swollen starch granules shall be referred to as being "fully cooked." The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes. Other exemplary starch binders that can be used include modified cationic starches such as those modified to have nitrogen containing groups, including amino groups and methylol groups attached to nitrogen, available from National Starch and Chemical Company, (Bridgewater, New Jersey), that have previously been used as pulp furnish additives to increase wet and/or dry strength.

F. Other Oitional Wipe Components

Besides the high internal phase inverse emulsion, there are other optional components that can be included in the articles of the present invention, typically for the purpose of improving the cleaning performance of the article when the internal polar phase of the emulsion is released. Certain of these optional components cannot be present in the emulsion at significant levels (e.g., greater than 2% of the internal polar phase) because they can cause premature disruption of the emulsion. These include various anionic detergent surfactants that have relatively high HLB values (e.g., HLBs of from about 10 to about 25), such as sodium linear alkylbenzene sulfonates (LAS) or alkyl ethoxy sulfates (AES), as well as nonionic detergent surfactants such as alkyl ethoxylates, alkyl amine oxides, alkyl polyglycosides, zwitterionic detergent surfactants, ampholytic detergent surfactants, and cationic detergent surfactants such as cetyl trimethyl ammonium salts, and lauryl trimethyl ammonium salts. See U.S. Pat. No. 4,597,898 (Van der Meer), issued Jul. 1, 1986 (herein incorporated by reference), especially columns 12 through 16 for representative anionic, nonionic, zwitterionic, ampholytic and cationic detergent surfactants. Instead, these high HLB detergent surfactants can be applied or included in the article separately from the emulsion. For example, an aqueous emulsion of these high HLB detergent surfactants can be applied to one side of the carrier substrate, with the high internal phase inverse emulsion being applied to the other side of the substrate. During wiping, the emulsion is disrupted, releasing the internal polar phase (e.g., water) so that it can then be combined with the high HLB detergent surfactant to provide improved hard surface cleaning.

Though the description of the invention generally relates to applying a single emulsion to the carrier, it is recognized that two or more different emulsions may be utilized in preparing a single article. In such embodiments, the emulsions may differ in a variety of ways, including but not limited to the ratio of the internal polar phase and the external lipid phase, the emulsifiers used, the components used for either or both of the internal and lipid phases, and the like. Utilization of multiple emulsions in one article may be particularly desirable when two or more components are incompatible with each other, but can each be included in separate emulsions. Alternatively, if a particular reaction is desired at the time of use, the reactants can be provided in separate emulsions. Upon shearing of the emulsions during use, the desired reaction will occur. For example, where foaming is desired during the wiping processes, a mild acid can be incorporated in the internal polar phase of one emulsion, while bicarbonate is incorporated in the internal polar phase of a second emulsion. Upon shearing of the emulsions during use, the reactants interact to provide the desired foam.

G. Other Embodiments of Cleansing Articles

In addition to the configuration depicted in FIG. 1, cleansing articles in accordance with the present invention may be assembled in a variety of other alternative configurations while maintaining the advantages of the present invention.

FIG. 3 depicts one such alternative configuration, wherein the cleansing article 1 is similar in structure to that depicted in FIG. 1, but wherein the activation web 2 itself forms an external surface of the article. In such a configuration, if the activation web is liquid-permeable such as the formed film web of FIG. 2, the article may function as a two-sided cleansing article and release the active emulsion through either or both the activation web and the secondary web 3. Alternatively, if the activation web is liquid-impermeable, the article functions as a single-sided cleansing article by dispensing an active emulsion through only the secondary web.

H. Test Method—Wet Resiliency

Wet resiliency (i.e., wet caliper to dry caliper ratio) of an activation web is measured using a Thwing-Albert Instrument Co. Electronic Thickness Tester Model II, according to the following procedure. Samples are conditioned at 70° Ft and 50% relative humidity for two hours prior to testing.

The dry caliper of the activation is measured using a confining pressure of 95 g/i$^2$ and a load foot having a diameter of 2 in. The dry caliper is measured for eight samples. The eight caliper measurements are averaged to provide an average dry caliper.

Each sample is then wetted by submerging the sample in a distilled water bath for 30 seconds. The sample is then removed from the water bath and is allowed to drain for 5 seconds while hanging vertically. The caliper of the wet sample is measured within 30 seconds of removing the sample from the bath. The wet caliper is measured in the same location in which the dry caliper was previously measured. The eight wet caliper measurements are averaged to provide an average wet caliper. The wet caliper to dry caliper ratio is the average wet caliper divided by the average dry caliper.

If the activation web is a composite of multiple layers or materials, for the purpose of this measurement it will be necessary to calculate the resilience ratio of the individual components. For the purposes of this calculation, the following definitions apply:

a=initial dry caliper of the complete web b=initial dry caliper of the web distal to the emulsion c=initial dry caliper of the web proximal to the emulsion A=initial wet caliper of the complete web B=initial wet caliper of the web distal to the emulsion C=initial wet caliper of the web proximal to the emulsion where the resilience ratio is defined as A/a.; and where it is assumed that a,A, and either b,B or c,C can be measured. For this measurement, it is to be understood that one component of the composite web must be removed to facilitate measurement of the b,B;c,C; or both independently.

If one component of the composite web cannot be measured after having been removed from the composite, the resilience ratio can be calculated using the following expressions:

$$B/b=(A-C)/(a-c)C/c=(A-B)/(a-b)$$

I. Preparation of Representative Cleansing Articles

In preparing the articles according to the present invention, the high internal phase inverse emulsion is initially formulated. Typically, this is achieved by blending or melting together the lipid phase components and the emulsifier. The particular temperature to which this lipid/emulsifier mixture is heated will depend on the melting point of the lipid phase components. Typically, this lipid/emulsifier mixture is heated to a temperature in the range from about 60° to about 90° C., preferably from about 70° to about 80° C., prior to being mixed, blended or otherwise combined with the polar phase components. The melted lipid/emulsifier mixture is then blended with the polar internal phase components and then mixed together, typically under low shear conditions to provide the emulsion.

This high internal phase inverse emulsion is then applied in a fluid or plastic state at the temperatures indicated above to the carrier substrate, e.g., a paper web. Any of a variety of methods that apply materials having a fluid or plastic consistency can be used to apply this emulsion. Suitable methods include spraying, printing (e.g., flexographic or screen printing), coating (e.g., gravure coating), extrusion, or combinations of these application techniques, e.g. spraying the detergent surfactant on a paper web, followed by gravure coating of the emulsion on the detergent treated web.

The emulsion can be applied either to one side or both sides of the carrier web, or, in the case of multi-ply webs, can be applied to the inner surface(s) of the plies. Once the emulsion has been applied to the carrier web, it is allowed to cool and form a solidified, typically discontinuous coating or film on the surface of the web.

The high internal phase inverse emulsion is typically applied to the carrier web after the web has been dried, i.e. a "dry web" addition method, for webs which are initially wet-formed. The emulsion can also be applied nonuniformly to the surface(s) of the web. By "nonuniform" is meant that the amount, pattern of distribution, etc. of the emulsion can vary over the surface of the carrier web. For example, some portions of the surface of the carrier web can have greater or lesser amounts of the emulsion, including portions of the surface that do not have any emulsion thereon.

The high internal phase inverse emulsion can be applied to the carrier web at any point after it has been dried. For example, the emulsion can be applied to the surface of a paper web after it has been creped from a Yankee dryer. Usually, it is preferred to apply the emulsion to the carrier web as it is being unwound from a parent roll and prior to being wound up on smaller, finished product rolls.

Figure 5:
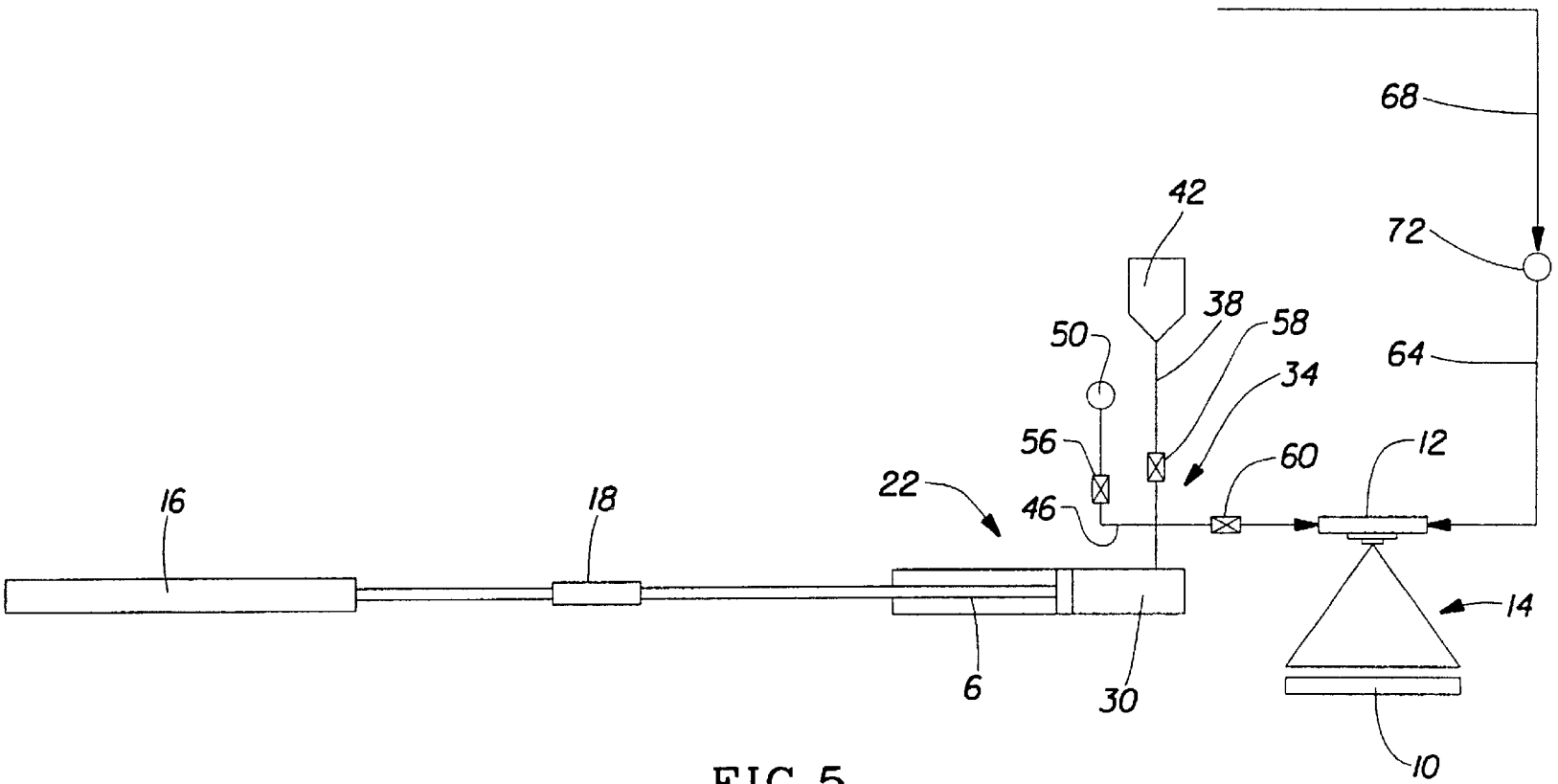
FIG. 5 is a schematic representation illustrating a spray system suitable for use in applying a high internal phase inverse emulsion to a carrier substrate.

In applying high internal phase inverse emulsions of the present invention to carrier webs, spray coating methods are presently preferred. FIG. 5 illustrates one such preferred method where the emulsion is sprayed onto a carrier web 10. Referring to FIG. 5, this spray system has a spray head 12 that applies a dispersed spray 14 of the emulsion onto web 10.

This spray system is actuated by an assembly that consists of a ball screw drive 16 that is connected by coupling 18 to a piston 26 of hydraulic cylinder 22. A portion of cylinder 22 is shown in FIG. 5 as being filled with the high internal phase inverse emulsion as indicated by 30. Cylinder 22 is heated to keep emulsion 30 in a fluid or plastic state. Emulsion 30 enters cylinder 22 via a 4-way coupling 34 that has a line 38 connected to a heated filling port 42. Coupling 34 also has a line 46 that is connected to pressure gauge 50 and spray head 12. There are three valves indicated as 56, 58 and 60 that control the flow of the emulsion in lines 38 and 46. The spray system shown in FIG. 5 also has a line 64 connected to spray head 12 that allows air indicated generally as 68 to be admitted to the spray head. Line 64 also has a pressure gauge and regulator 72 for controlling and measuring the air pressure in line. Lines 64 and 46 are heated to maintain the emulsion in a molten state prior to application to the web.

To fill cylinder 22 with emulsion 30, valves 56 and 60 are closed and valve 58 is opened. Ball screw drive 16 is actuated so that piston 26 moves to the left. The vacuum created in cylinder 22 draws the emulsion from filling port 42 through line 38 and into cylinder 22. To provide emulsion from cylinder 22 to spray head 12, valve 58 is closed and valves 56 and 60 are opened. The ball screw drive 16 is actuated so that piston 26 moves to the right. This forces emulsion 30 out of cylinder 22 and into line 46 of coupling 34. The emulsion then passes through valve 60 and into the spray head 12 where it is dispersed by incorporation of air from line 64 to provide dispersed spray 14 that is then applied to web 10.

Figure 6:
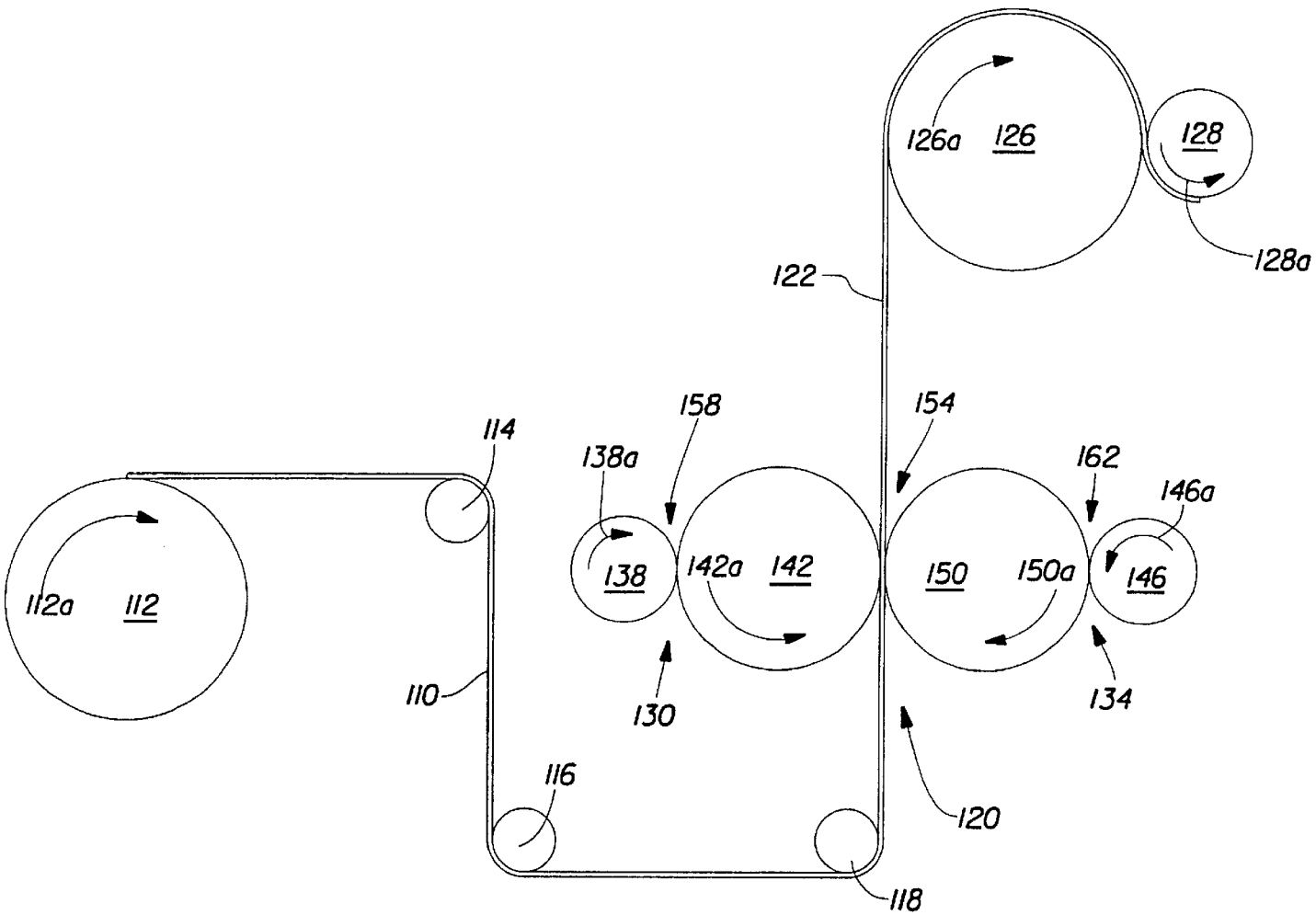
FIG. 6 is a schematic representation illustrating a rotogravure coating system suitable for use in applying a high internal phase inverse emulsion to a carrier substrate.

FIG. 6 illustrates an alternative method for applying the high internal phase inverse emulsion involving a rotogravure coating system. Referring to FIG. 6, a carrier web 110 is unwound from parent roll 112 (rotating in the direction indicated by arrow 112*a*) and advanced around turning rolls 114, 116 and 118. From turning roll 118, web 110 is advanced to a gravure coating station indicated generally as 120 where the emulsion is then applied to both sides of the web. After leaving station 120, web 110 becomes a treated web indicated by 122. Treated web 122 is advanced to surface rewinder roll 126 (rotating in the direction indicated by arrow 126*a*) and then wound up on finished product roll 128 (rotating in the direction indicated by arrow 128*a*).

Station 120 comprises a pair of heated linked gravure presses 130 and 134. Press 130 consists of a smaller anilox cylinder 138 and a larger print plate cylinder 142; press 134 similarly consists of a smaller anilox cylinder 146 and a larger print plate cylinder 150. Anilox cylinders 138 and 146 each have a ceramic or chrome surface, while print plate cylinders 142 and 150 each have a relief patterned rubber, urethane, or photopolymer surface. These anilox and print plate cylinders rotate in the directions indicated by arrows 138*a*, 142*a*, 146*a* and 150*a*, respectively. As shown in FIG. 6, print plate cylinders 142 and 150 are opposed to one another and provide a nip area indicated by 154 through which web 110 passes. Hot, molten (e.g., 60° C.) emulsion is pumped to or sprayed onto each of these linked gravure presses 130 and 134 at the nip areas indicated by arrows 158 and 162, respectively, at a constant volumetric flow rate. (Emulsion delivered to presses 130 and 134 may be the same or different.) In other words, the emulsion is added to the linked gravure presses 130 and 134 at the same rate as the emulsion is being applied to the web 110. This eliminates emulsion "build-up" in the system. As anilox cylinders 138 and 146 rotate in the directions indicated by arrows 138*a* and 146*a*, they act as rotating doctor blades to spread the emulsion evenly across the surfaces of print plate cylinders 142 and 150, respectively, and to remove excess emulsion from the print plates of cylinders 142 and 150.

The emulsion that is spread onto print plate cylinders 142 and 150 (rotating in the opposite direction as indicated by arrows 142*a* and 150*b*) is then transferred to both sides of web 110 at nip area 154. The amount of the emulsion transferred to web 110 can be controlled by: (1) adjusting the width of nip area 154 between print plate cylinders 142 and 150; (2) adjusting the width of nip areas 158 and 162 between anilox/print plate cylinder pairs 138/142 and 146/150; (3) the print image relief(i.e., valley depth) of the print plate on cylinders 142 and 150; (4) the print area (i.e., valley area) of the print plate on cylinders 142 and 150; and/or (6) the print pattern of the print plate on cylinders 142 and 150.

EXAMPLE 1

This example illustrates the preparation of a cleaning article comprising an emulsion contained between two plies of a composite activation web. The activation web is prepared by printing a polymer network onto the surface of a cellulosic web. Such an activation web is depicted in FIG. 4A. The emulsion is printed onto the activation web such that the polymer network is directly contacting the emulsion in the completed article.

A) Activation Web (1) Cellulosic Web Preparation

The cellulosic web component of the activation web is a tissue paper substrate. The base paper is a 100% NSK, non-layered sheet with a basis weight of 20 lbs/ream (about 32.5 gsm). The paper has a plurality of high basis weight zones and low basis weight zones. The paper was produced according to the teachings of US Pat. No. 5,506,715 (Trokhan, et al) with the following specifics:

1) The forming wire contained 100 protuberances per square inch.
2) The protuberances occupied about 50% of the surface area of the forming wire.
3) The protuberances extended above the forming wire reinforcing structure about 0.004 inches.
4) The apertures of each protuberance occupied about 10% of the surface area of the forming wire.
5) In the wet end of the conventional papermaking process, a 2% amino-silicone (available from General Electric as CM 22666D1) is injected into the NSK pulp slurry at a ratio of 0.004 lbs. of amino silicone solids per pound of dry paper.
6) In the wet end of the conventional papermaking process 1% of Kymene 2064 (Available from Hercules Inc.) is injected into the NSK pulp slurry at a ratio of 20 pounds of Kymene solids per ton of dry paper.

(2) Polymer Addition

An adhesive polymer is printed on the paper substrate in a predetermined pattern to provide three-dimensional, textured regions to the substrate. Referring to FIG. 4A, the printed regions are designated 110, and the unprinted regions are designated 114. In particular, in a preferred embodiment, polymer is applied by screen printing. A suitable screen printer is Model SP-117 from ITW Dynatec. The polymer used is an EVA hot melt generally available as H1382-01 from Ato-Findley Adhesives of Wauwatosa, Wis. A suitable screen for this embodiment is a 40 mesh Galvano screen manufactured by Rothtec Engraving Corp., New Bedford, Mass. The macroscopic printing pattern used is a lattice pattern of intersecting straight lines. The lines are approximately 0.0625 inches in width and are spaced apart by about 0.5 inches. These lines intersect at approximately an 80 degree angle thereby forming a pattern of discrete, diamond shaped untreated regions.

C) Emulsion Preparation

A 1000 g batch of an emulsion (88.65% internal phase) is prepared from the ingredients shown in Table 1.

TABLE I

| | Amount (gm) | Percentage |
|---|---|---|
| Lipid Phase Ingredients | | |
| Yellow Ceresine Wax (Strahl & Pitsch SP983) | 60 | 6.0 |
| Petrolatum (Fisher) | 10 | 1.0 |
| White Ozokerite Wax (Strahl & Pitsch SP1190) | 20 | 2.0 |
| Dow Corning 5200 | 20 | 1.0 |
| ICI CP1215 | 1.0 | 0.1 |
| Dow Corning 5921 | 10 | 1.0 |
| Polar Phase Ingredients: | | |
| Sodium Sulfate | 1.0 | 0.1 |
| EDTA | 1.0 | 0.1 |
| Propylene Glycol | 20 | 2.0 |
| Glydent Plus | 3.0 | 0.3 |
| Distilled Water | 884.0 | 86.4 |

To formulate the internal polar phase, all polar phase components are mixed together and then heated to 140° F. (45.8° C.). Separately, the lipid phase ingredients are heated, with mixing, to a temperature of about 140° F. until melted. The polar and lipid phase components are then combined in a stainless steel vessel and mixed with a Hobart Model 100-C mixer on the low speed setting while allowing the ingredients to cool slowly. Mixing is continued until the emulsion forms. Emulsion formation is evidenced by an increase in viscosity above 2000 centipoise as measured with a Lab-Line Instruments rotating disc viscometer.

D) Applving Emulsion to Activation Web

The emulsion prepared in step C is applied to the activation web using a rotogravure printing process essentially the same as that shown in FIG. 6, except that only one gravure press (130) is utilized. (Also, rewinder roll 126 is not utilized in preparing the article described by this example.) The emulsion is maintained at a temperature of 135° F. so that it is liquid or molten. A positive displacement pump moves the emulsion to the gravure press 130 at the nip area indicated by arrow 158 at a constant volumetric flow rate of 380 ml/minute. Anilox cylinder 138 spreads the emulsion evenly across the surface of the print cylinder 142 (rotating at about 40 feet per minute). Cylinder 142 then transfers the emulsion to one side of web 110 (cylinder 150 is used at a back-up cylinder to maintain constant impression on web 110).

The coated activation web (i.e. the polymer network and paper web) is then folded such that the emulsion is contained within the interior of the article. The surface of the composite web with the polymer network is also contained on the interior of the article, in contact with the emulsion. Combining, perforating, and sealing can be accomplished using techniques known to the art.

EXAMPLE 2

This example illustrates the preparation of a moisture releasing wipe comprising an emulsion contained between a secondary paper web and an activation web. The activation web consists of a formed film laminated to a paper web. The emulsion is applied to the formed film side of the laminate. Further processing would enclose the emulsion between the secondary web and the film side of the activation web, as shown in FIG. 1.

A) Secondary Web Preparation

The secondary web is a tissue paper substrate. The base paper is a 100% NSK, non-layered sheet with a basis weight of 20 lbs/ream (about 32.5 gsm). The paper has a plurality of high basis weight zones and low basis weight zones. The paper was produced according to the teachings of US Pat. No. 5,506,715 (Trokhan, et al) with the following specifics:

1) The forming wire contained 100 protuberances per square inch.
2) The protuberances occupied about 50% of the surface area of the forming wire.
3) The protuberances extended above the forming wire reinforcing structure about 0.004 inches.
4) The apertures of each protuberance occupied about 10% of the surface area of the forming wire.
5) In the wet end of the conventional papermaking process, a 2% amino-silicone (available from General Electric as CM 22666D1) is injected into the NSK pulp slurry at a ratio of 0.004 lbs. of amino silicone solids per pound of dry paper.
6) In the wet end of the conventional papermaking process 1% of Kymene 2064 (Available from Hercules Inc.) is injected into the NSK pulp slurry at a ratio of 20 pounds of Kymene solids per ton of dry paper.

B) Activation Web Preiaration:

The activation web is prepared by laminating a formed film web with a paper layer similar in composition to the secondary web described above, the formed film being approximately half the width of the paper web. This difference in width is to enable folding after the emulsion has been applied such that the finished product has an activation web on only one side of the emulsion, as shown in FIG. 1.

The formed film is a three-dimensional, macroscopically-expanded web of polymeric materials prepared according to the teachings of U.S. Pat. No. 4,342,314 issued to Radel. et al. on Aug. 3, 1982. The formed film has a three-dimensional microstructure comprising a regulated continuum of tapered capillary networks originating in and extending from the first surface 42 in plane 43 and terminating in the second surface 44 in plane 45, forming apertures in both surfaces. The apertures measure about 0.040 inches in one surface and about 0.016 inches in the other surface. The overall height between plane 43 and plane 45 is about 0.012 inches. The microstructure has a density of about 625 capillary per square inch. The base portion 54, located in plane 43, may include microscopic aberrations 60, generally in accordance with the teachings of commonly assigned U.S. Pat. No. 4,463,045, issued to Ahr et al. on Jul. 31, 1984. The surface aberrations 60 may be outwardly projecting protuberances or inwardly projecting depressions, and measures at least 0.0002 inches from the plane the aberrations originate. The average distance between adjacent surface aberrations is less than 0.004 inches.

This formed film is laminated to the paper layer using a hot melt adhesive, H2031, generally available from Ato-Findley Adhesives of Wauwatosa, Wisconsin. In this example, the more textured side of the formed film is oriented towards the emulsion (i.e. the glue used in the laminating process is applied to the less textured side). The hot melt adhesive is applied using a screen printer (Model SP-117 from ITW Dynatec) in a continuous pattern.

C) Emulsion Preparation

A 1000 g batch of an emulsion (88.65% internal phase) is prepared from the ingredients shown in Table II.

TABLE II

| | Amount (gm) | Percentage |
|---|---|---|
| Lipid Phase Ingredients | | |
| Yellow Ceresine Wax (Strahl & Pitsch SP983) | 60 | 6.0 |
| Petrolatum (Fisher) | 10 | 1.0 |
| White Ozokerite Wax (Strahl & Pitsch SP1190) | 20 | 2.0 |
| Dow Corning 5200 | 20 | 1.0 |
| ICI CP1215 | 1.0 | 0.1 |
| Dow Corning 5921 | 10 | 1.0 |
| Polar Phase Ingredients: | | |
| Sodium Sulfate | 1.0 | 0.1 |
| EDTA | 1.0 | 0.1 |
| Propylene Glycol | 20 | 2.0 |
| Glydent Plus | 3.0 | 0.3 |
| Distilled Water | 884.0 | 86.4 |

To formulate the internal polar phase, all polar phase components are mixed together and then heated to 140° F. (45.8° C.). Separately, the lipid phase ingredients are heated, with mixing, to a temperature of about 140° F. until melted. The polar and lipid phase components are then combined in a stainless steel vessel and mixed with a Hobart Model 100-C mixer on the low speed setting while allowing the ingredients to cool slowly. Mixing is continued until the emulsion forms. Emulsion formation is evidenced by an increase in viscosity above 2000 centipoise as measured with a Lab-Line Instruments rotating disc viscometer.

D) Applving Emulsion to Activation Web

The emulsion prepared in step C is applied to the more textured side (i.e., formed film side) of the activation web using a spraying process similar to that shown in FIG. 5. The emulsion is maintained at a temperature of 135° F. so that it is liquid or molten. A positive displacement pump moves the emulsion to the spray head indicated by arrow 12 at a constant volumetric flow rate of 625 ml/minute for a 25 fpm line speed. No air flow passes through line 64 to enable continuous beads to be applied to the paper web. Next, the secondary web is laminated activation web, as shown in FIG. 1. The finished article 10 is then perforated (apparatus for sealing, folding, and perforating is not depicted in FIG. 4A) to yield the finished product wipe.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A cleansing article, which comprises:

an activation web having a first surface having one or more regions that exhibit a textured, three-dimensional surface topography and a second surface, the activation web having a ratio of wet caliper to dry caliper (resilience ratio) of at least 0.9;

a secondary web, the activation web and the secondary web being at least peripherally joined to one another; and a multi-phase, muli-component emulsion that is in direct contact with the first surface of the activation web during use.

2. The cleansing article of claim 1, wherein the activation web comprises a three-dimensional, macroscopically-expanded forned film.

3. The cleansing article of claim 1, wherein the one or more regions of the activation web that are textured comprises an adhesive polymeric material.

4. The cleansing article of claim 1, wherein the one or more regions of the activation web that are textured comprises a particulate material.

5. The cleansing article of claim 1, wherein the emulsion comprises:

From about 2% to about 60% by weight of a continuous lipid phase comprising a lipid material having a melting point of about 30° C. or higher;

From about 39% to about 97% by weight of an internal polar phase dispersed in the lipid phase; and an effective amount of an emulsifier capable of forming the emulsion when the lipid phase is in a fluid state.

6. Thie cleansing article of claim 5, wherein the lipid material is a wax.

7. The cleansing article of claim 1, wherein the cleansing article comprises a second secondary web peripherally joined to the second surface of the activation web and opposite the first secondary web.

8. A cleansing article which comprises:

(a) an activation web having a first surface having one or more regions that exhibit a textured, three-dimensional surface topography and a second surface, the activation web having a ratio of wet caliper to dry caliper (resilience ratio) of at least 0.9; and (b) a multi-phase, multi-component emulsion that is in direct contact with the first surface of the activation web during use.

9. The cleansing article of claim 8, wherein the activation web has a resilience ratio of at least about 0.95.

10. The cleansing article of claim 9, wherein the activation web has a resilience ratio of at least about 0.98.

11. The cleansing article of claim 8, wherein the activation web comprises a three-dimensional, macroscopically-expanded formed film.

12. The cleansing article of claim 8, wherein the activation web comprises a thermoplastic material.

13. The cleansing article of claim 8, wherein the activation web comprises a capillaiy web structure.

14. The cleansing article of claim 8, wherein the activation web is fluid permeable.

15. The cleansing article of claim 8, wherein the activation web is fluid impermeable.

16. The cleansing article of claim 8, wherein the cleansing article comprises a first secondary web peripherally joined to the first surface of the activation web and in direct contact with the emulsion during use.

17. The cleansing article of claim 8, wherein the one or more regions of the activation web that are textured comprises an adhesive polymeric material.

18. The cleansing article of claim 8, wherein the one or more regions of the activation web that are textured comprises a particulate material.

19. The cleansing article of claim 8, wherein the emulsion comprises:

From about 2% to about 60% by weieht of a continuous lipid phase comprising a lipid material having a rnelting point of about 30° C. or higher;

From about 39% to about 97% by weight of an internal polar phase dispersed in the lipid phase; and an effective amount of an emulsifier capable of forming the emulsion when the lipid phase is in a fluid state.

20. The cleansing article of claim 19, wherein the lipid material is a wax.

* * * * *

UNITED STATES PATENT AND TRADEMARK OFFICE

CERTIFICATE OF CORRECTION

PATENT NO. : 6,683,041 B1
DATED : January 27, 2004
INVENTOR(S) : Nissing et al.

It is certified that error appears in the above-identified patent and that said Letters Patent is hereby corrected as shown below:

Column 14,
Line 35, please delete “Secondarv” and insert therefor -- Secondary --.

Column 15,
Line 15, please delete “papernaking” and insert therefor -- papermaking --.

Column 17,
Line 44, please delete “Oitional” and insert therefor -- Optional --.

Column 19,
Line 24, please delete “B/b=(A-C)/(a-c)C/c=(A-B)/(a-b)” and insert therefor
-- B/b=(A-C)/(a-c) C/c=(A-B)/(a-b) --.

Column 22,
Line 21, after “Table” please delete “1” and insert therefor -- I --.
Line 52, please delete “Applving” and insert therefor -- Applying --.

Column 23,
Line 43, please delete “Preiaration:” and insert therefor -- Preparation: --.

Column 24,
Line 47, please delete “Applving” and insert therefor -- Applying --.

Column 25,
Line 2, after “article” please delete “,” (the comma).
Line 11, please delete “muli-component” and insert therefor -- multi-component --.
Line 16, please delete “forned” and insert therefor -- formed --.
Line 19, please delete “prises” and insert therefor -- prise --.
Line 32, please delete “Thie” and insert therefor -- The --.

UNITED STATES PATENT AND TRADEMARK OFFICE

CERTIFICATE OF CORRECTION

PATENT NO. : 6,683,041 B1
DATED : January 27, 2004
INVENTOR(S) : Nissing et al.

It is certified that error appears in the above-identified patent and that said Letters Patent is hereby corrected as shown below:

Column 26,
Line 16, please delete “capillaiy” and insert therefor -- capillary --.
Line 33, please delete “weieht” and insert therefor -- weight --.
Line 34, please delete “rnelt” and insert therefor -- melt --.

Signed and Sealed this

Twenty-sixth Day of July, 2005

JON W. DUDAS
*Director of the United States Patent and Trademark Office*